US009771183B1

(12) United States Patent
Oliver

(10) Patent No.: US 9,771,183 B1
(45) Date of Patent: Sep. 26, 2017

(54) CONVERTIBLE DIAPER BAG AND METHODS THEREFOR

(71) Applicant: Sarinya Oliver, Arlington, TX (US)

(72) Inventor: Sarinya Oliver, Arlington, TX (US)

( * ) Notice: Subject to any disclaimer, the term of this patent is extended or adjusted under 35 U.S.C. 154(b) by 53 days.

(21) Appl. No.: 14/679,978

(22) Filed: Apr. 6, 2015

Related U.S. Application Data

(60) Provisional application No. 61/976,312, filed on Apr. 7, 2014.

(51) Int. Cl.

| | |
|---|---|
| ***A45C 7/00*** | (2006.01) |
| ***A47D 13/02*** | (2006.01) |
| ***B65D 33/00*** | (2006.01) |
| ***B65D 30/22*** | (2006.01) |
| ***B65D 33/04*** | (2006.01) |

(52) U.S. Cl.
CPC ..... *B65D 33/004* (2013.01); *B65D 31/12* (2013.01); *B65D 33/04* (2013.01)

(58) Field of Classification Search
CPC ..... B65D 33/004; B65D 33/04; B65D 31/12
USPC ..... 206/459.5, 459.1; 381/106; 383/106, 4; 190/2; 5/655
See application file for complete search history.

(56) References Cited

U.S. PATENT DOCUMENTS

| | | | | | |
|---|---|---|---|---|---|
| 770,354 | A * | 9/1904 | Corfman | A45C 3/00 | 223/108 |
| 3,777,862 | A * | 12/1973 | Zipper | A45C 3/004 | 190/107 |
| 3,944,032 | A * | 3/1976 | Samhammer | A45C 5/06 | 190/113 |
| 4,068,786 | A * | 1/1978 | Taniguchi | A45C 9/00 | 150/108 |
| 5,554,093 | A * | 9/1996 | Porchia | B44F 1/10 | 383/106 |
| 5,649,658 | A * | 7/1997 | Hoffman | A45F 3/04 | 190/2 |
| 5,868,227 | A * | 2/1999 | Garcia | A45C 5/06 | 150/106 |
| 6,298,993 | B1 * | 10/2001 | Kalozdi | A45C 3/00 | 150/106 |
| 6,334,519 | B1 * | 1/2002 | Tong | A45C 3/00 | 190/107 |
| 6,390,260 | B1 * | 5/2002 | Roegner | A45C 3/00 | 190/1 |
| 8,490,230 | B2 * | 7/2013 | Rovin | A47D 5/006 | 190/2 |
| 2007/0104396 | A1 * | 5/2007 | Paulin | B65D 33/004 | 383/106 |

* cited by examiner

*Primary Examiner* — Chun Cheung
(74) *Attorney, Agent, or Firm* — Jeffrey Roddy

(57) ABSTRACT

An bag with a top, a bottom and sides, wherein at least one side is convertible to a washable diaper changing surface. The diaper changing surface includes a flap that is movable from a closed state to an open state providing a portion of the diaper changing surface, and in the closed state sequesters soiled surfaces and items to prevent contamination of the remainder of the bag. The bag includes a number of pockets, sleeves and other cavities having visual indicators responsive to pocket contents, that indicate at a glance whether the pocket contains an item, or is empty.

6 Claims, 12 Drawing Sheets

CONVERTIBLE DIAPER BAG AND METHODS THEREFOR

CROSS-REFERENCE TO RELATED APPLICATIONS

This Non-Provisional Application claims the benefit of U.S. Provisional Application No. 61/976,312 filed Apr. 7, 2014 and titled: "Diaper Bag and Methods Therefor."

FIELD

The present invention relates generally to pocketed bags and satchels including backpacks, diaper bags and the like, and more particularly to a integrated diaper changing system having means for indicating the contents status of plural pockets.

BACKGROUND

Diaper bags of various kinds are long known in the art. Some of these bags incorporate transparent pockets so that the contents of the pockets are visible without opening the pockets for inspection. Despite transparent pockets, it is the case with busy travelers or parents having small children that essential items intended for transport or travel are often missed when packing because of the numerous items required. In addition, with conventional diaper bags, when changing a baby diaper, a mat which is separable from the diaper bag must be employed.

Although the aforementioned bags are suitable for their intended use, the problem of overlooked or redundant items persists.

It would be desirable to provide a means for quickly assessing whether essential items have been packed without having to individually count the items or directly visually inspect each pocket's contents.

It would be further desirable to provide the foregoing assessment means via a change in a symbol that indicates at a glance the instant status of a group of pockets; i.e., which pockets are filled or empty.

It would be especially desirable to provide the foregoing assessment means in the form of a binary visual indicator indicating either empty or full status of a pocket wherein the indicator changes from one state to another when contents are inserted or removed from the pocket.

It would be even further desirable to provide at least the foregoing features with an integrated diaper changing system.

Textual information can be employed along with the binary visual indicator in order to indicate the intended contents of a particular pocket; e.g., the words "phone", "diapers", "wipes", etc., can be used alongside the visual indicator.

SUMMARY

The present invention is an integrated diaper changing system that permits instant assessment of a pocketed bag's contents by way of pockets having a transformative visual symbol wherein the symbol possesses a first state that indicates an empty pocket and a second state that indicates a filled pocket. The visual symbol is transformed by removing an article from a pocket or inserting an article into a pocket. Each pocket possesses a translucent front facing surface having a first visual indicator, a back surface with a second visual indicator and a contents space between the front facing surface and the back surface. Because the back surface is visible through the front facing surface, when the pocket is empty, the first and second indicators combine to form a third indicator that indicates an absence of pocket contents. The system of the invention further incorporates a bag body comprising a floor, a back inner wall and two upright inner side panels. A folding portion comprised of panels forms the back, top and front faces of the bag when closed, and when open, extends from the bag floor to form a fluid impermeable baby mat for changing diapers. The folding portion defining a mat has a flap transversely attached midway along the mat. The flap is affixable to the mat in two positions, (1) closed, toward the distal end of the mat, and (2) open, toward the bag body. Magnetic clasps reversibly affix the flap to the mat in either position. In the open position, the mat may be used to change a diaper. After changing the diaper, the flap is moved to the closed position whereby it sequesters any mess, and isolates and protects the interior of the bag from same.

In one aspect of the present invention, at least one pocket of a pocketed bag possesses a visual indicator that transforms from one state to another when contents are placed in the pocket or removed therefrom.

In another aspect of the present invention, at least one pocket of a pocketed bag possesses a transformative visual indicator along with a textual cue 119 for the intended pocket contents.

in yet another aspect of the present invention, a pocketed bag includes ergonomic shoulder straps that are attached to a top of the bag body at an angle of between 25° and 35° relative to the straps and the seamed connection to the bag.

The foregoing and other objects, features, and advantages of the invention will become more apparent from the following detailed description, which proceeds with reference to the accompanying figures wherein the scale depicted is approximate.

DETAILED DESCRIPTION OF THE INVENTION

Reference Listing

Figure 1:
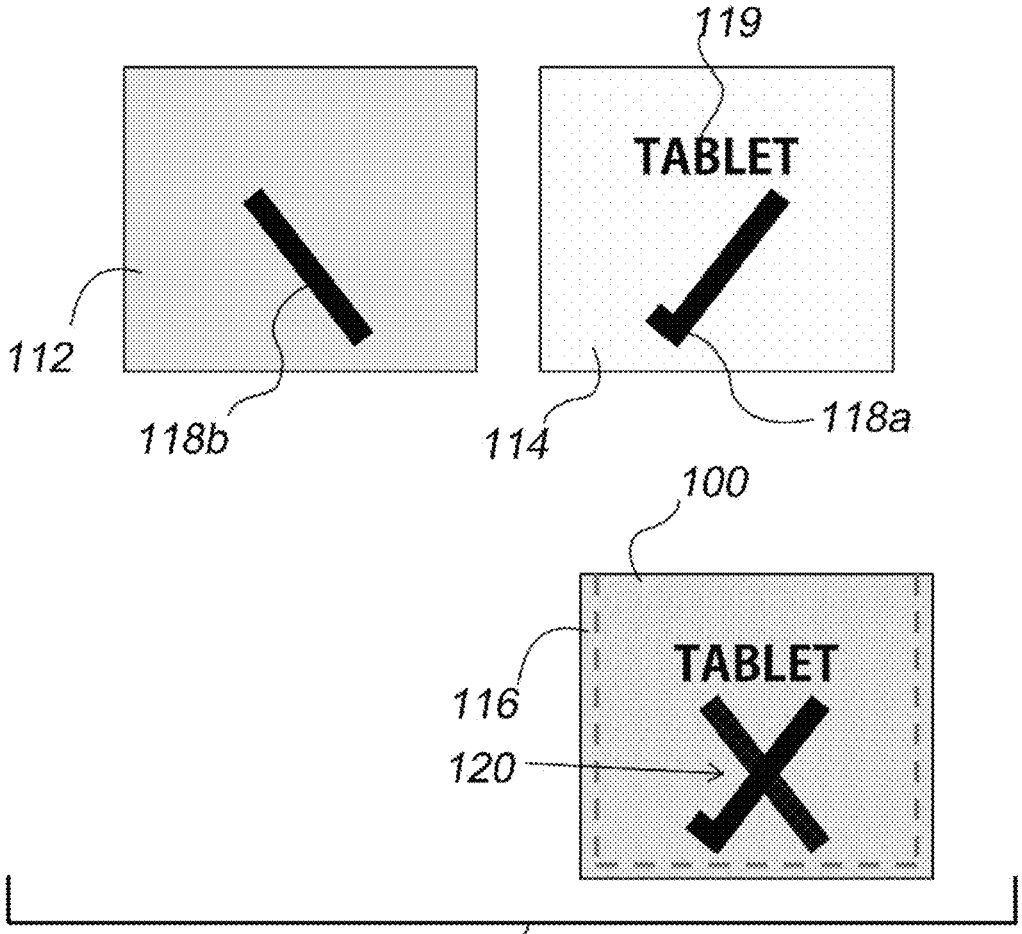
FIG. 1 is a plan view of one embodiment according to the present invention showing parts of a pocket construction.

100 bag
110 pocket
112 pocket back
114 pocket front
116 stitching
118 visual indicator
118*a* first indicator symbol
118*b* second indicator symbol
119 textual indicator
120 combined indicator symbol
122 article
224 flap
224*a* magnetic catch
226 floor
228 side
232 top side
233 front side wall
234 front flap
235 back side
236 bag edges
238 folding portion edges
240 diaper changing surface
242 shoulder straps
244 inside edge shoulder straps
246 outside edge shoulder straps

Definitions

In the following description, the term "bag" refers to any travel bag, satchel, diaper bag or other container for transporting plural articles. The term "indicator" refers to a visual indicator that is symbolic, pictorial, or iconic. The term "textual indicator" refers to descriptive text. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Referring generally to FIGS. 1 through 4, a travel bag 100 includes a plurality of pockets 110, each having a transforming visual indicator that indicates at a glance which pockets are without contents. The pockets have a front 114, a back 112 and a space therebetween for the retention of articles. The front face of the pocket has a first indicator 118*a* thereon and the back face has a second indicator 118*b* thereon. When the front face is directly adjacent the back face, the indicators combine to create a third indicator 120 that indicates the pocket is empty. Preferably, the third indicator is an "X." When the pocket is filled, only the first indicator is visible. Preferably, the first indicator is a check mark symbol.

FIG. 1 is a group showing in plan view, a first indicator 118*a*, second indicator 118*b* and a combined indicator 120.

Figure 2:
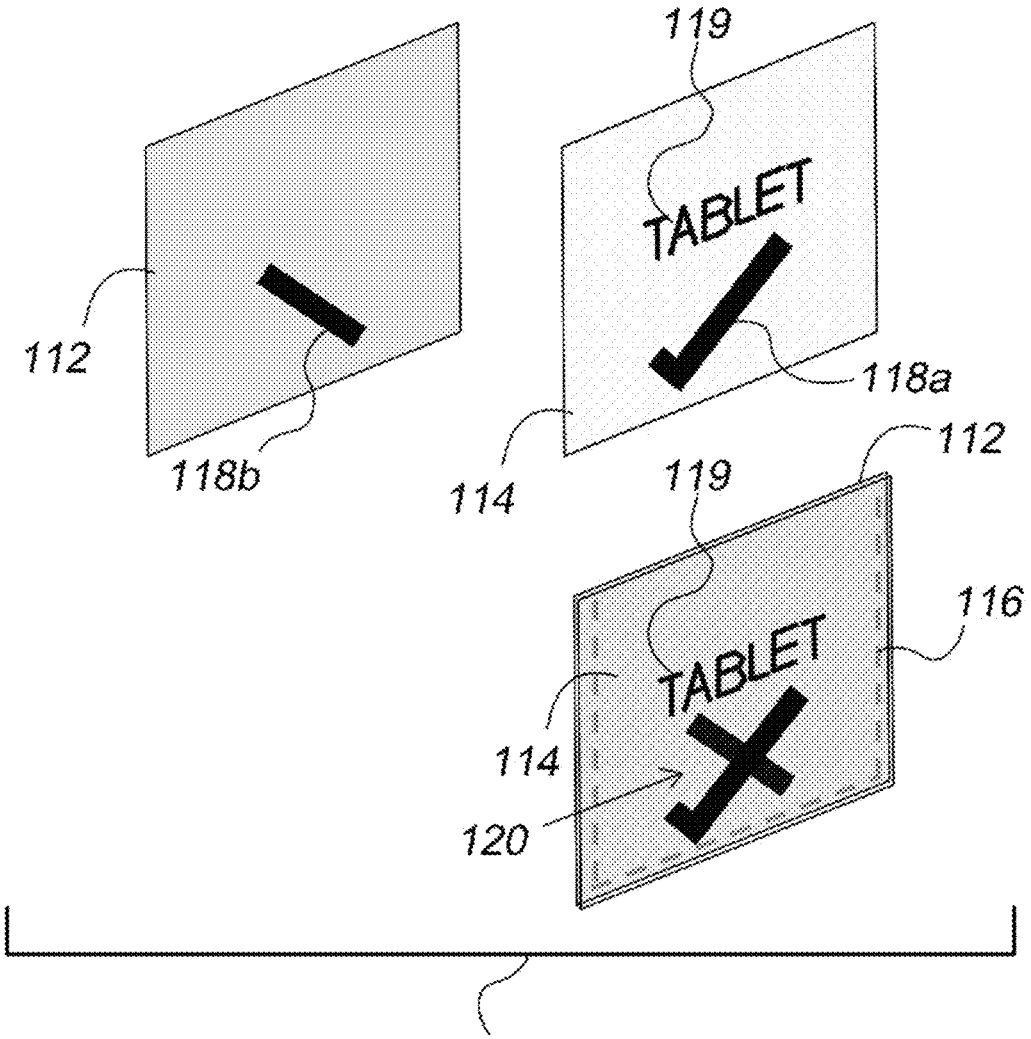
FIG. 2 is a angular view of the embodiment shown in (FIG. 1)

FIG. 2 is a group showing in isometric view, a first indicator, second indicator and a combined indicator.

Figure 3:
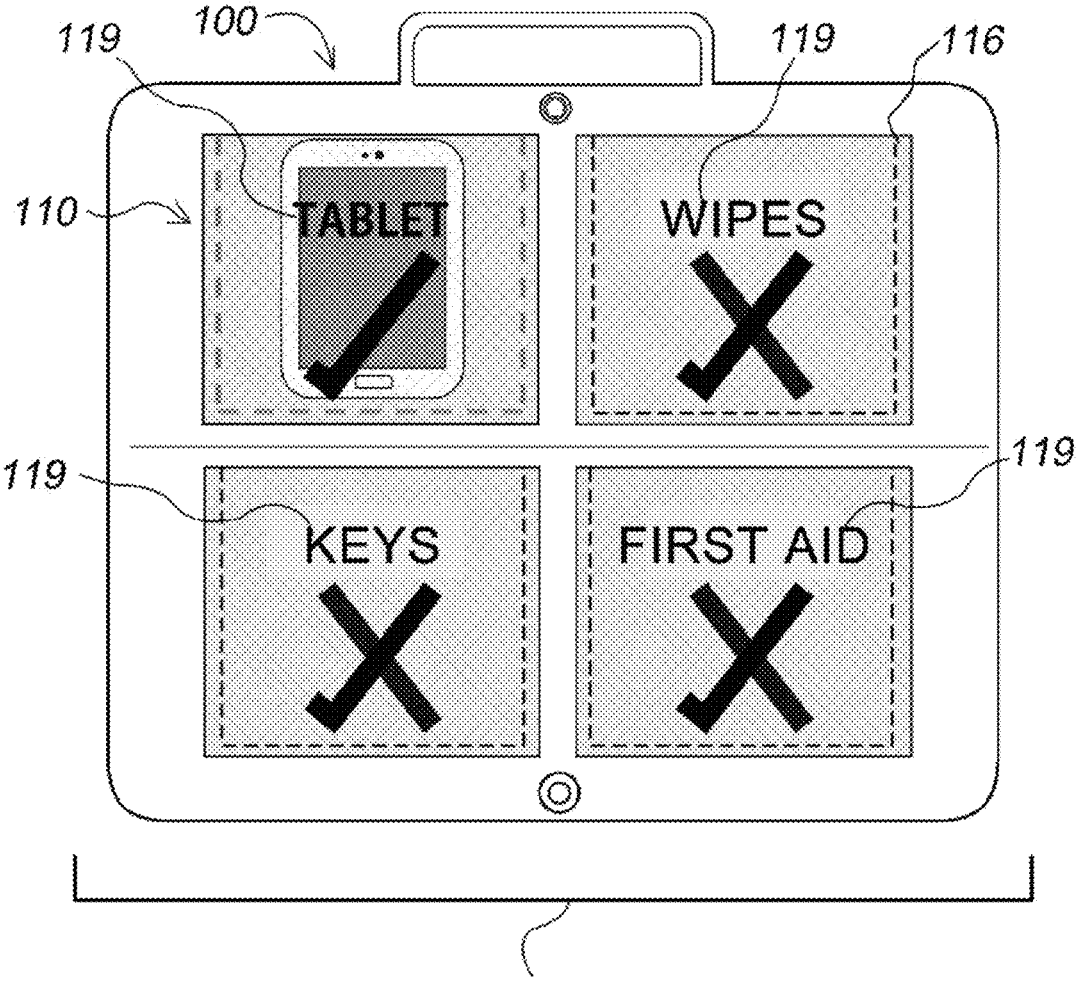
FIG. 3 is a plan view of a bag having multiple pockets with visual indicators.

FIG. 3 is a plan view showing a bag with four pockets. With the exception of the top left pocket, all pockets are empty. By means of the visual indicators, empty pockets can be ascertained at a single glance. This is especially advantageous when packing quickly.

Figure 4:
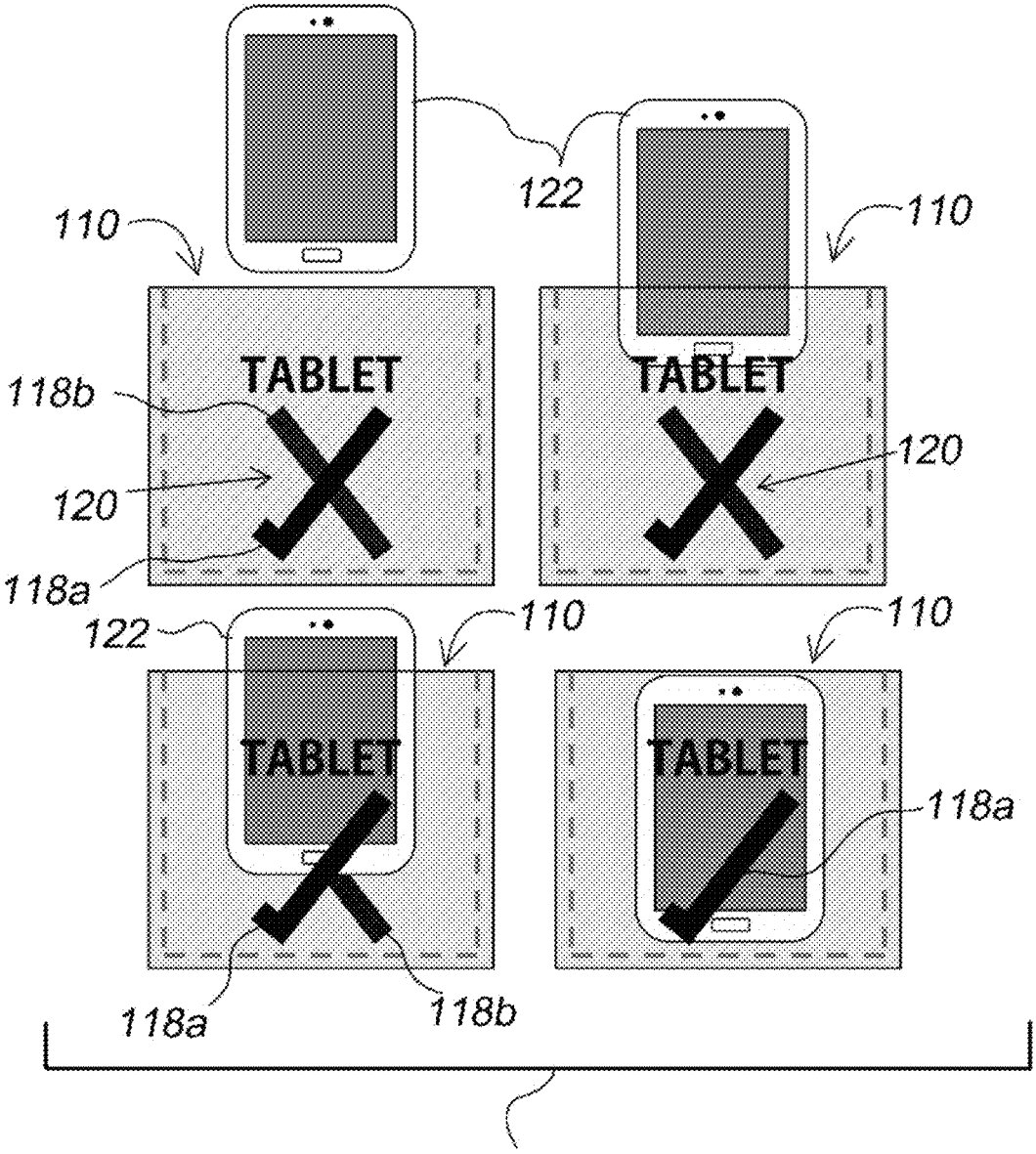
FIG. 4 is plan view of a pocket undergoing sequential transformation when an article is inserted in the pocket.
Figure 5:
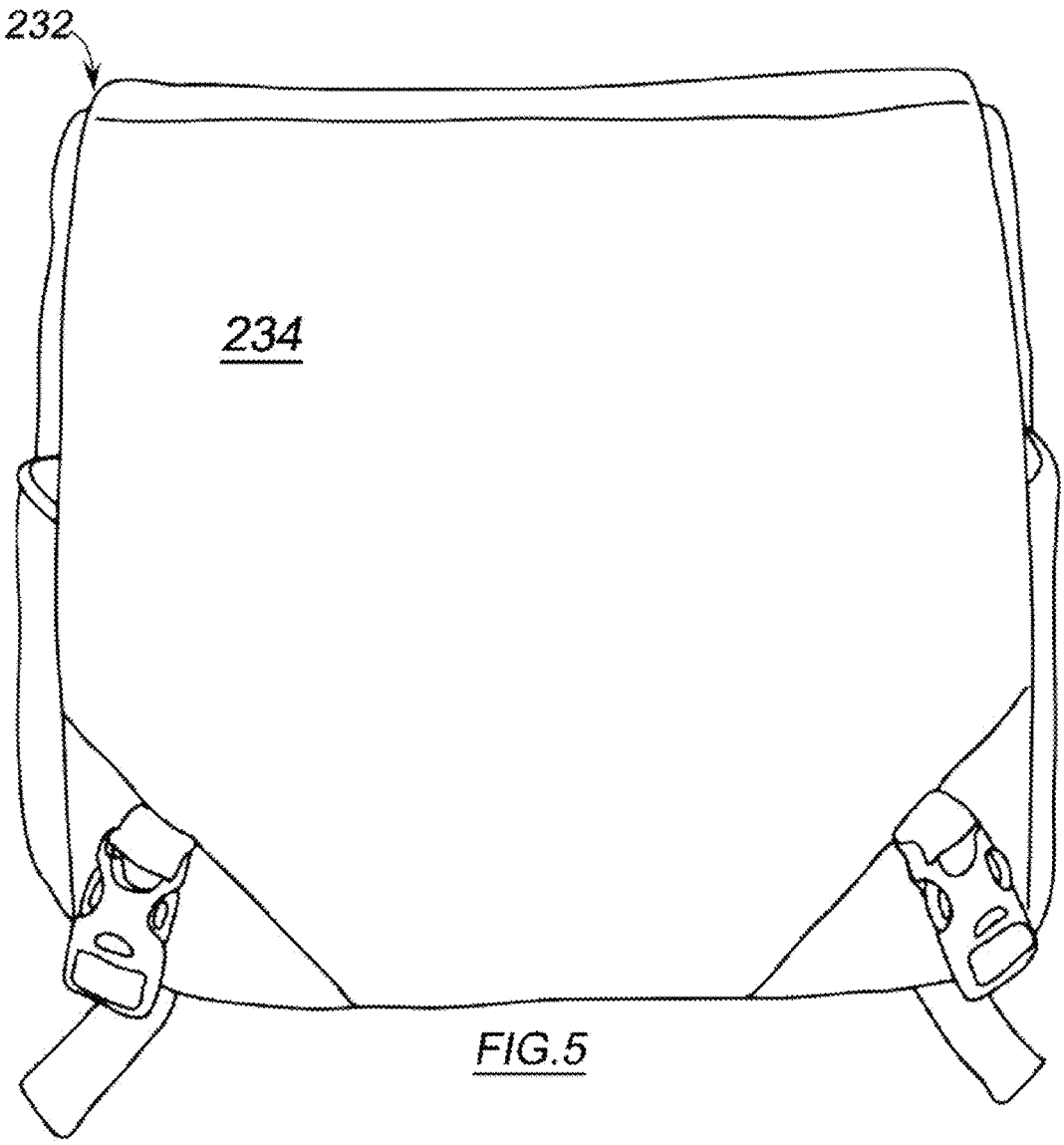
FIG. 5 is a front perspective exterior view of one embodiment according to the present invention.
Figure 6:
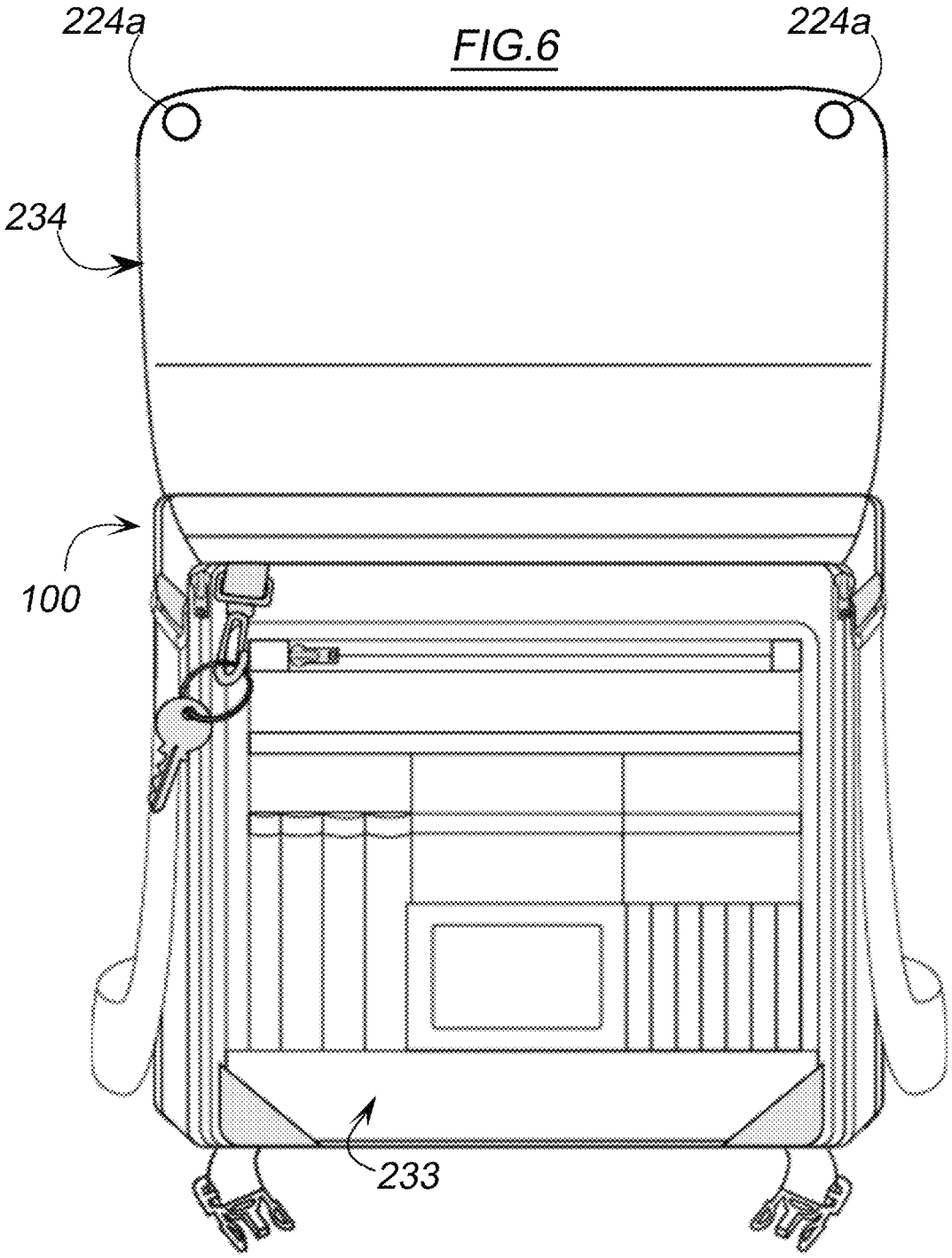
FIG. 6 is a front perspective view of one embodiment according to the present invention.

FIG. 4 is a group showing a sequential transformation of a combined indicator 120 which when separated into its constituent parts by the insertion of an article 122 into the pocket, shows only the first indicator 118*a* indicating that the pocket is filled.

The pocket front 114 can be plastic, netting, or any suitably clear or translucent material such that the pocket back and any indicia thereon is visible when viewed through the pocket front. The pocket back can be part of a bag or a separate element. While in the embodiment depicted, stitching is used to join the pocket front to the back, other suitable methods and materials for forming pocket elements will be appreciated by those having skill in the art and can be employed without departing from the intended invention. Although in the embodiment depicted, a "check" symbol combines with an "slant" symbol to create an "X" symbol, other transformative symbols are conceivable that would indicate pocket content status. The visual indicators can be applied by printing, embossing or any suitable method.

Figure 7:
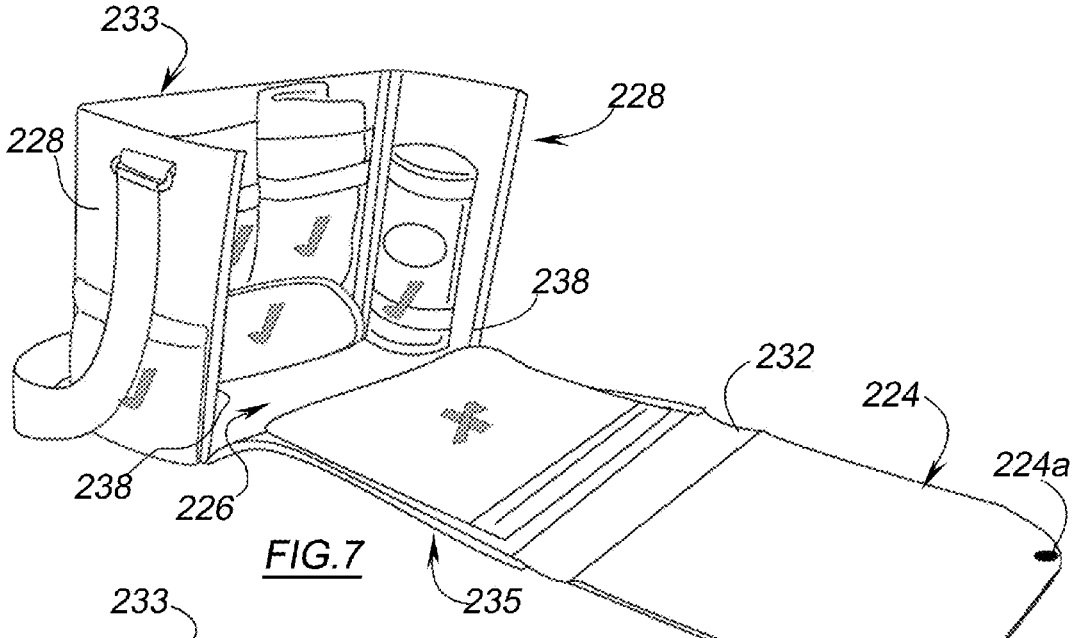
FIG. 7 is a perspective side view of one embodiment according to the present invention with folding flap 224 in closed position.
Figure 8:
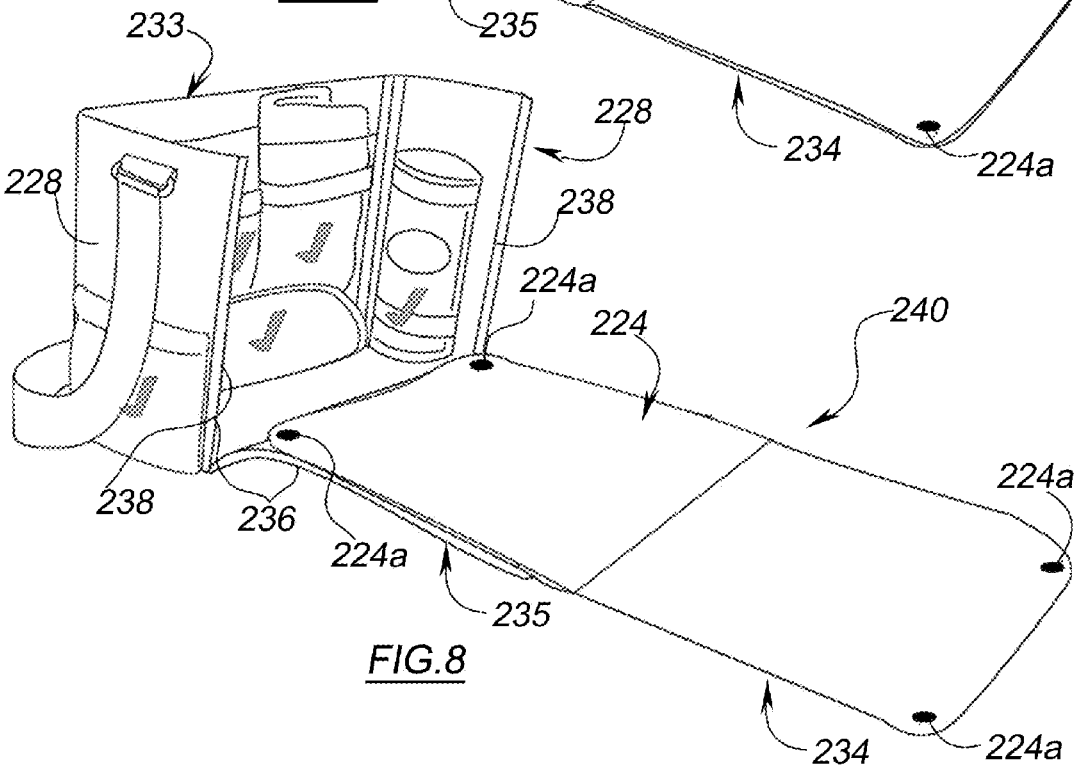
FIG. 8 is a perspective side view of one embodiment according to the present invention with folding flap 224 in open position.
Figure 9:
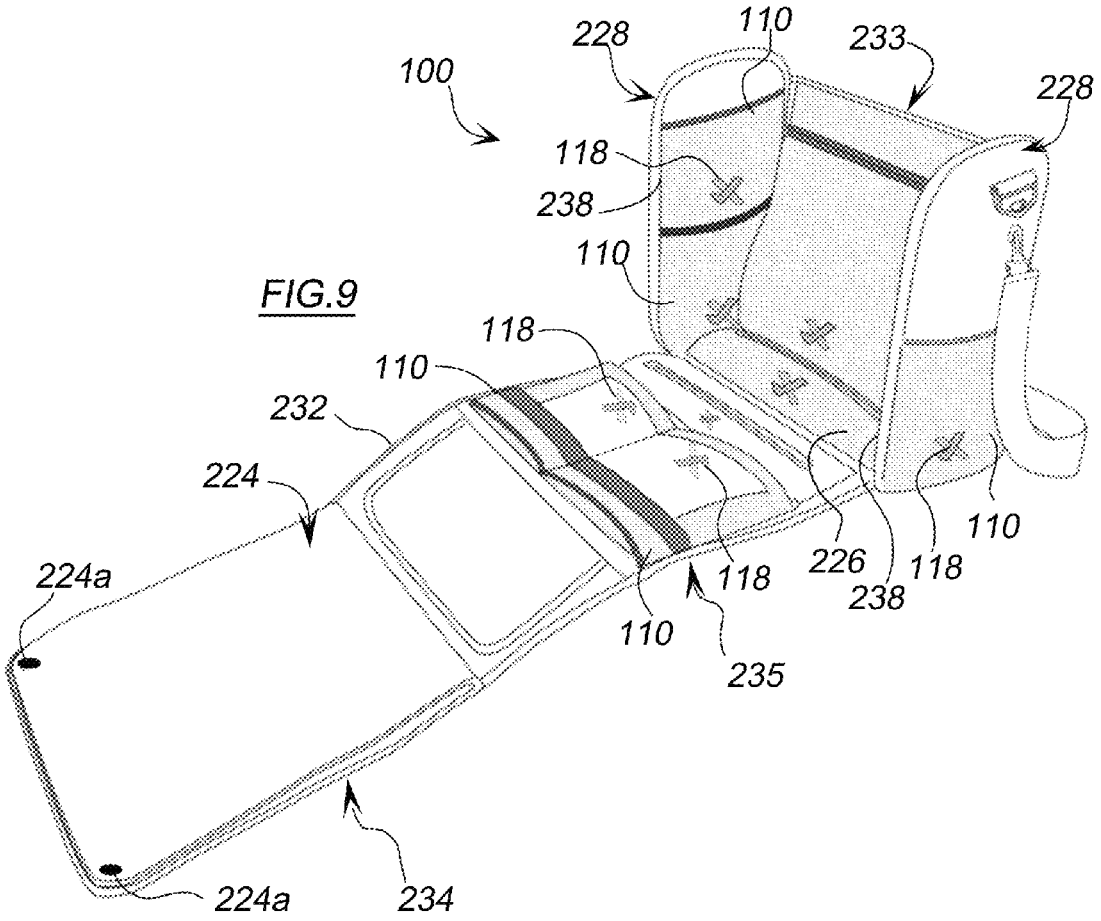
FIG. 9 is a perspective side view of another embodiment according to the present invention with folding flap 224 in closed position.
Figure 10:
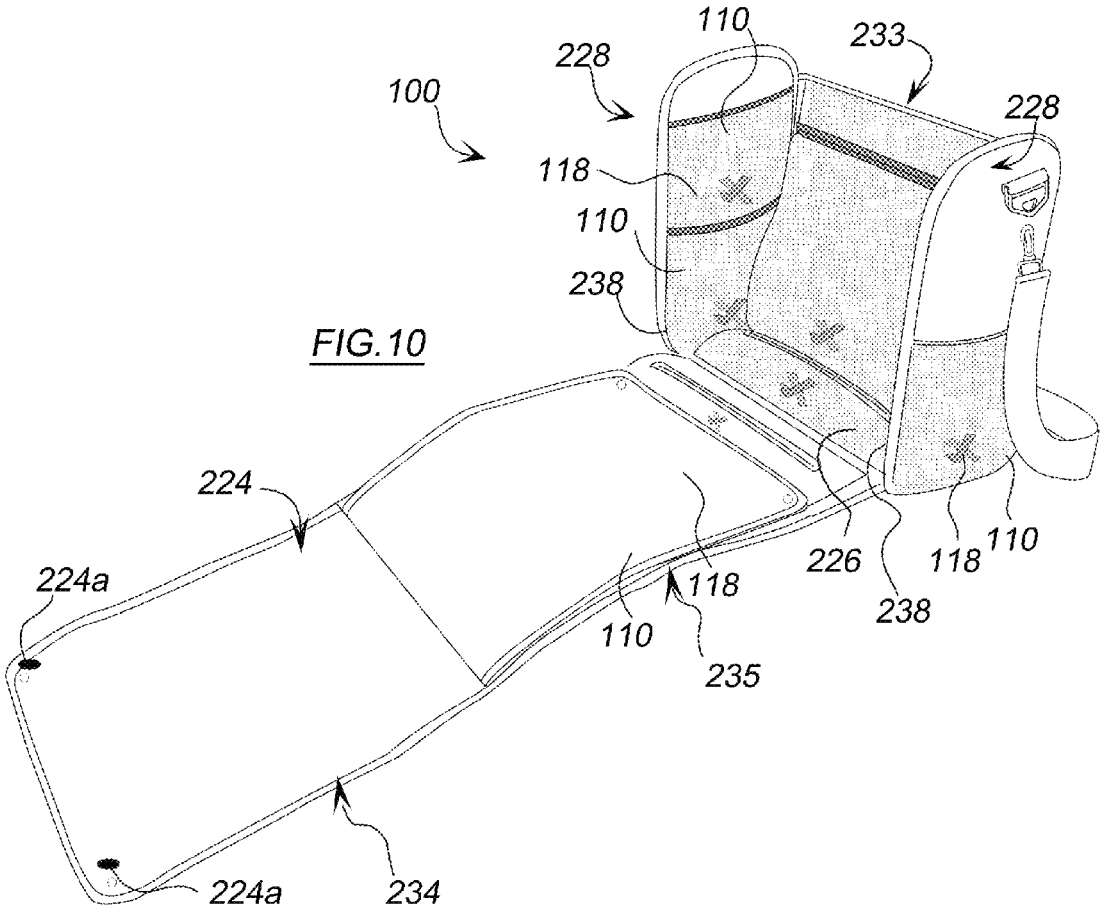
FIG. 10 is a perspective view showing the folding flap of the embodiment of (FIG. 9) in an open position for facilitating a diaper change.
Figure 11:
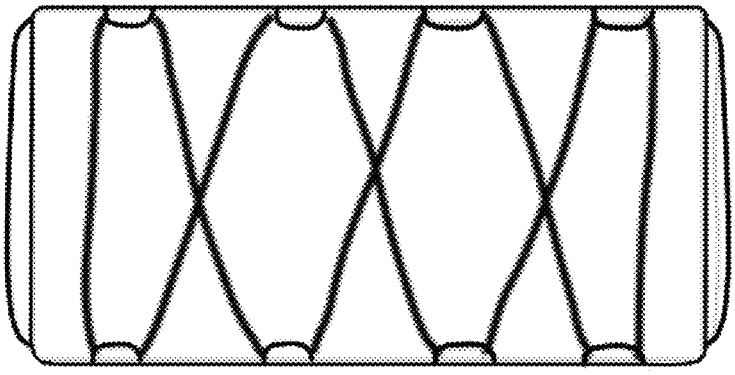
FIG. 11 is perspective view of diaper bag bottom with elastic banding for retention of diapers/miscellaneous items.

Referring to FIGS. 5-11, a diaper bag 100 incorporating the aforementioned features includes a bag body having a floor 226, sides 228, and a folding portion that in a closed position, forms the bag back 235, top side 232 and front flap 234, and in an open position extends from the bag floor providing a diaper changing surface 240. As best seen in FIGS. 7 and 8, the folding portion includes a flap 224 transverse the diaper changing surface that is movable from a closed position (FIG. 7) to an open position (FIG. 8) for diaper changing, and back to a closed position after diaper changing is concluded. This has the advantage of protecting the remainder of the bag and bag contents from contamination and facilitates easy cleaning of the diaper changing surface. The diaper cleaning flap and surface is fluid impermeable. Any readily disinfectable plastic, vinyl or polymeric fabric may be used. Magnetic catches 224*a* which may be ceramic magnetic discs that may be affixed to the surface or sewn into the flap and bag lining enable the flap to retain an open or closed position. When the diaper changing surface is not in use, edges of folding portion 236 are zipped to the edges 238 of the bag sides 228 whereby the folding portion forms the top and front flap of the closed bag.

As best shown by the embodiments depicted in FIGS. 7 and 8 and FIGS. 9 and 10, any number of pockets or sleeves in any configuration for article retention may be added to any side of the bag. The folding panels of the bag may also include any number and configuration of pockets, slots or pouches while still providing a relatively flat changing surface. As best shown in FIGS. 1-4, each pocket may be labeled with its contents, e.g., diaper wipes, cream, bottles, toys, blankets or extra clothing. Other items such as cell phones, keys, tablets, etc., may be accommodated by additional pockets that may be labeled or unlabeled.

Figure 12:
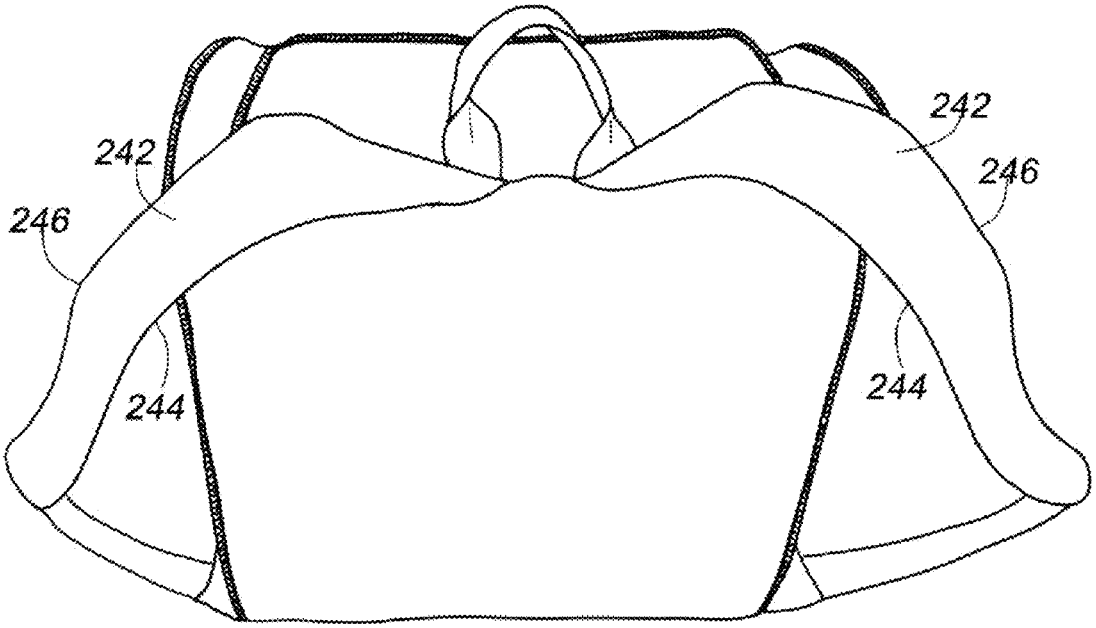
FIG.12 prior art
FIG. 12 is a back view of a prior art bag with typical shoulder straps that twist when spread apart.
Figure 13:
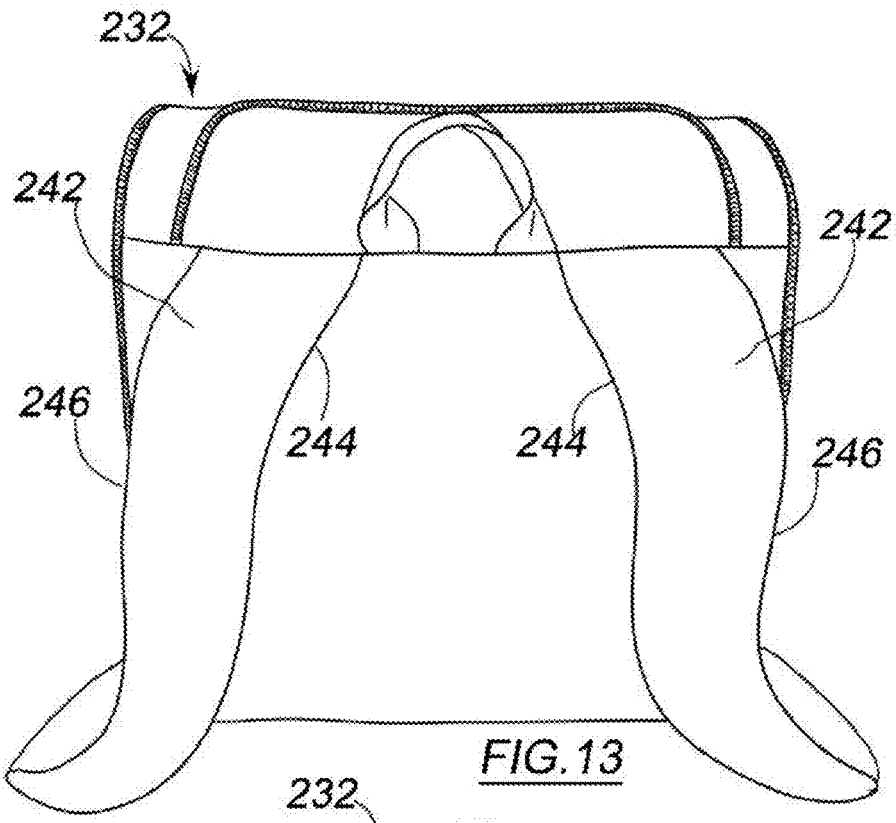
FIG. 13 is back view of one embodiment according to the present invention that includes shoulder straps joined at an angle to the bag top which permits the straps to spread apart when being worn without twisting.
Figure 14:
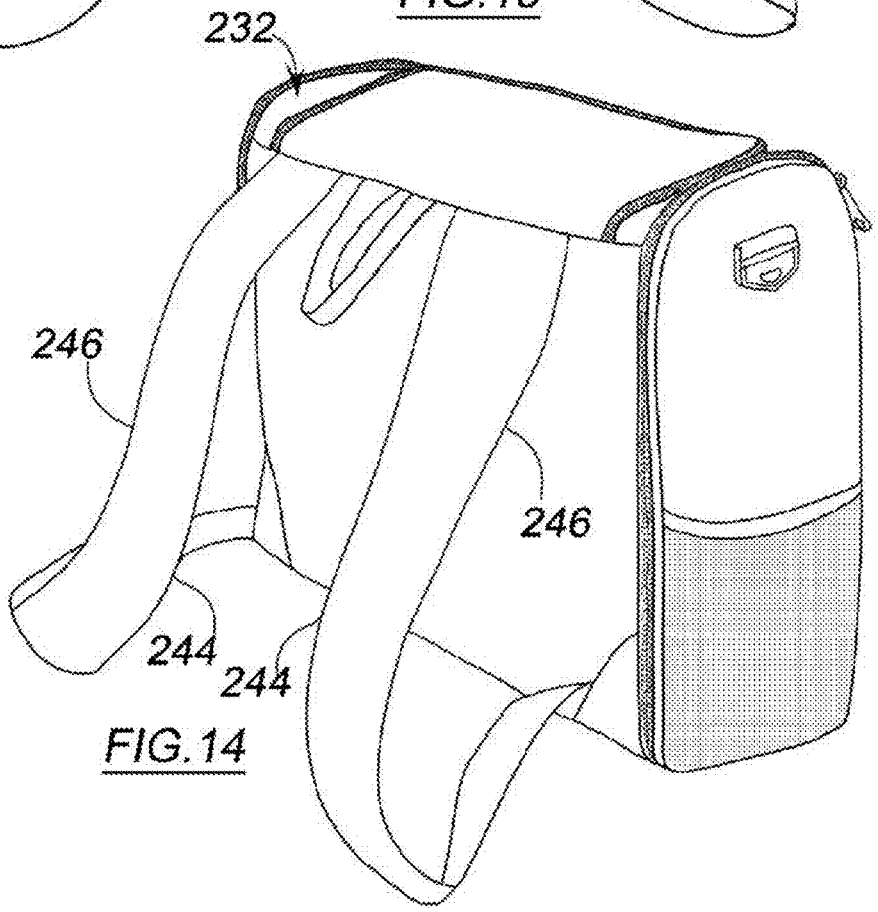
FIG. 14 is a side perspective view of the embodiment shown in (FIG. 13)
Figure 15:
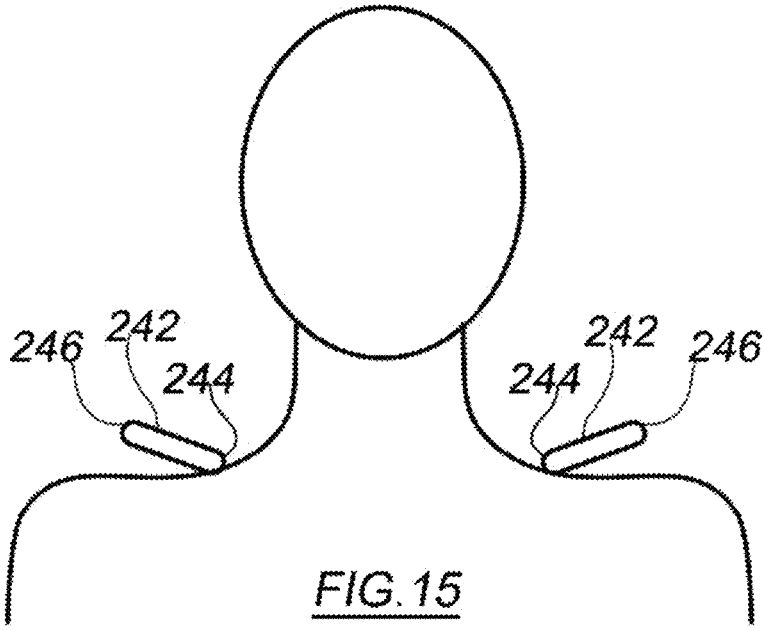
FIG. 15 is a diagrammatic view showing a prior art shoulder strap configuration.
Figure 16:
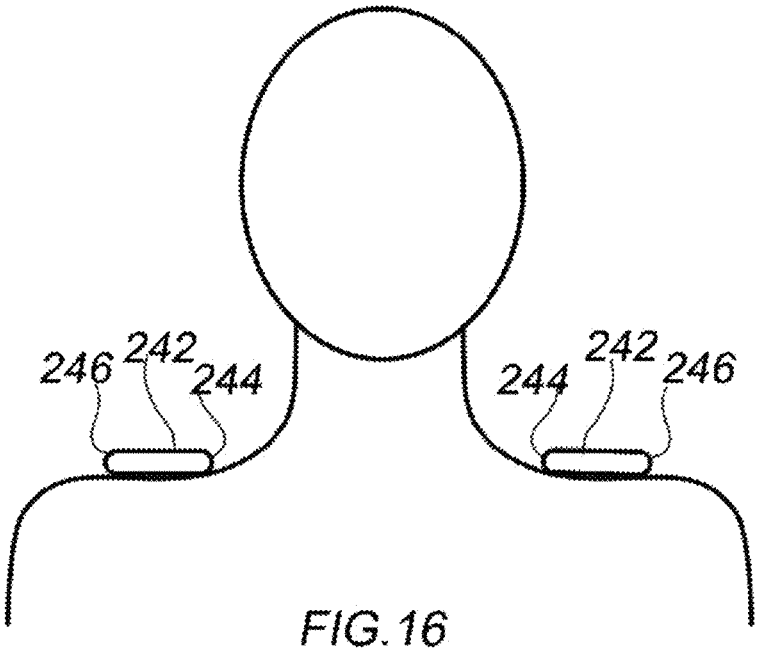
FIG. 16 is a diagrammatic view showing increased shoulder contacting area resulting from the shoulder strap configuration of (FIG. 13).

FIG. 12 depicts a prior art bag with shoulder straps being connected to the bag in such a way to cause twisting of the shoulder straps when the bag is worn, such that the outside edges 246 are pivoted upward and the inside edges 244 of the straps are pivoted downward against a wearer's shoulders causing pain an discomfort due to uneven weight distribution. FIGS. 13 and 14 depict one embodiment of the bag wherein the shoulder straps 242 are attached to bag top 232 at an angle between 25° and 35° relative to the straps and the seamed connection to the bag. FIGS. 15 and 16 depict diagrammatically how the contacting regions of shoulder straps 242 differ between the typical prior art configuration (FIG. 12) and certain embodiments of the invention. In the embodiment shown in FIGS. 13, 14 and 16, the straps lay flat against the shoulder for better weight distribution and comfort.

Overlapping or woven elastic cording may be added to any side of the bag for purposes of retaining odd shaped miscellaneous articles.

A bag carrying strap can be attached anywhere on the bag body.

It should be understood that the drawings and detailed description herein are to be regarded in an illustrative rather than a restrictive manner, and are not intended to be limiting to the particular forms and examples disclosed. Accordingly, it is intended that this disclosure encompass any further modifications, changes, rearrangements, substitutions, alternatives, design choices, and embodiments as would be appreciated by those of ordinary skill in the art having benefit of this disclosure, and falling within the spirit and scope of the following claims.

What is claimed is:

1. A bag comprising:

1) a bag including at least a floor, a back side, a top side, a front side wall and sides between the back side and the front side wall, the bag further including a plurality of pockets wherein at least one of the plurality of pockets has a see-through front face, a back surface and a gap between the front face and back surface;

2) a first indicator visible on the front face, and a second indicator visible on the back surface, wherein when the front face and back surface of each pocket are directly adjacent, a combined indicator is formed indicating that the pocket is devoid of contents;

3) a closed bag configuration wherein an extendable portion of the bag includes a first panel forming the back side of the bag and a second panel forming the top side of the bag and a third panel overlapping the front side wall of the bag, and wherein the first panel and second panel and third panel are conjoined; and, an open bag configuration wherein the conjoined first panel, second panel and third panel of the extendable portion are pivotable away from the bag floor and convertible to a diaper changing portion adapted to expose an interior of the bag from the top side and back side, the diaper changing portion includes a means to avoid cross contamination of the bag interior including a pivotable flap attached to the diaper changing portion which is configured to expose a diaper changing surface of the diaper changing portion in a first position and cover the diaper changing surface in a second position.

2. The bag according to claim 1 wherein when a pocket is filled with contents, only the indicator on the front face is visible.

3. The bag according to claim 1 further comprising descriptive text visible on the front face.

4. A bag comprising:

1) a bag including at least a floor adapted to rest in a flat disposition on a resting surface, a front side wall, a decouplable back side, a decouplable top side, sides between the front side wall and back side, an interior, and a plurality of pockets wherein at least one of the plurality of pockets has a see-through front face, a back surface and a gap between the front face and back surface;

2) the at least one pocket includes a visual indicator with two states responsive to contents of the at least one pocket indicating a filled or empty status of the at least one pocket;

3) a closed bag position comprising a decouplable front flap overlapping the front side wall; the decouplable front flap is conjoined with the decouplable top side and the decouplable back side, wherein the decouplable front flap, the decouplable top side and decouplable back side form a diaper changing panel that is pivotable away from the bag floor and adapted to expose the interior of the bag from the top side and back side and to rest in a flat disposition on a resting surface, the diaper changing panel includes a means to avoid cross contamination of the bag interior including a pivotable flap configured to expose a diaper changing surface of the diaper changing panel in an open diaper changing position and cover the diaper changing surface of the diaper changing panel in a closed diaper changing position.

5. The bag according to claim 4 wherein when a pocket is filled with contents, only the indicator on the front face is visible.

6. The bag according to claim 4 further comprising descriptive text visible on the front face.

* * * * *